United States Patent [19]

Rawlings

[11] Patent Number: 4,722,705

[45] Date of Patent: Feb. 2, 1988

[54] MARINE PROPULSION DEVICE WITH SWING ANGLE INDICATION MECHANISM

[75] Inventor: David E. Rawlings, Palatine, Ill.

[73] Assignee: Outboard Marine Corporation, Waukegan, Ill.

[21] Appl. No.: 744,482

[22] Filed: Jun. 13, 1985

[51] Int. Cl.[4] ..... B63H 5/12

[52] U.S. Cl. ..... 440/2; 340/984

[58] Field of Search ..... 114/144 E; 440/1, 2; 340/967, 974, 975, 976, 987, 689

[56] References Cited

U.S. PATENT DOCUMENTS

| | | | |
|---|---|---|---|
| 3,641,965 | 2/1972 | Schmiedel | 440/2 |
| 3,797,449 | 3/1974 | Carpenter et al. | 440/2 |
| 4,459,115 | 7/1984 | Ballard | 440/2 |
| 4,493,656 | 1/1985 | Inoue et al. | 440/2 |

FOREIGN PATENT DOCUMENTS

| | | |
|---|---|---|
| 1311453 | 3/1973 | United Kingdom . |
| 1460290 | 12/1976 | United Kingdom . |
| 1460289 | 12/1976 | United Kingdom . |
| 2146602 | 9/1983 | United Kingdom . |

*Primary Examiner*—Joseph F. Peters, Jr.
*Assistant Examiner*—Jesûs D. Sotelo
*Attorney, Agent, or Firm*—Michael, Best & Friedirch

[57] ABSTRACT

A marine propulsion device including a propulsion unit, a gimbal housing for mounting the propulsion unit on a boat transom for swinging movement, and a sending device for sensing the general angular position of the propulsion unit. The sending device comprises a resistance element having an end, a fixed resistor in parallel electrical connection with the resistance element, and a wiper supported on the gimbal housing for pivotal movement along the resistance element. The marine propulsion device also includes structure operable between the wiper and the propulsion unit for moving the wiper along the resistance element in an amount which is variably proportional to the amount of swinging movement of the propulsion unit, and for moving the wiper beyond the resistance element end as the propulsion unit moves beyond the predetermined angle.

13 Claims, 6 Drawing Figures

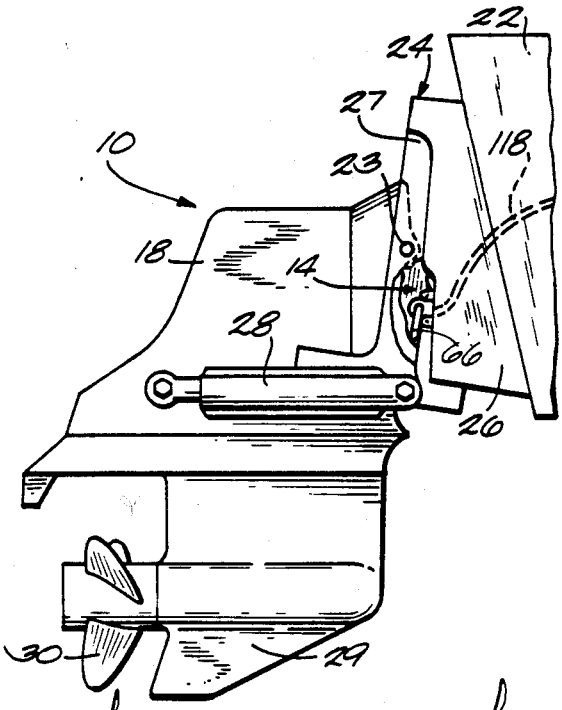
Fig. 1
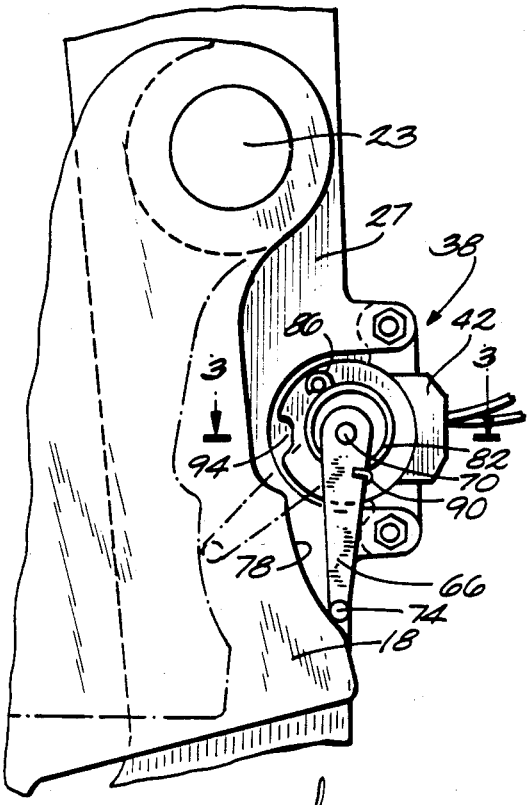
Fig. 2
Fig. 3
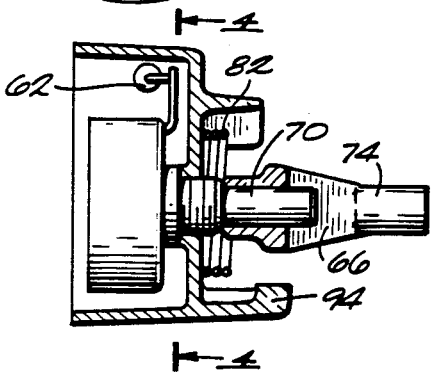
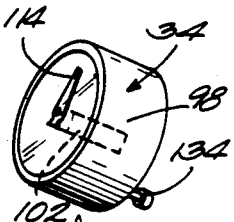
Fig. 6
Fig. 4
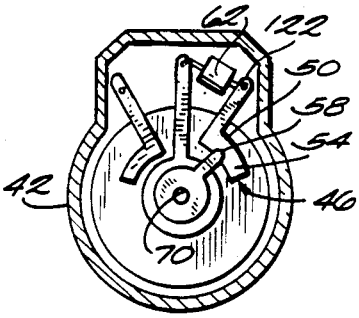
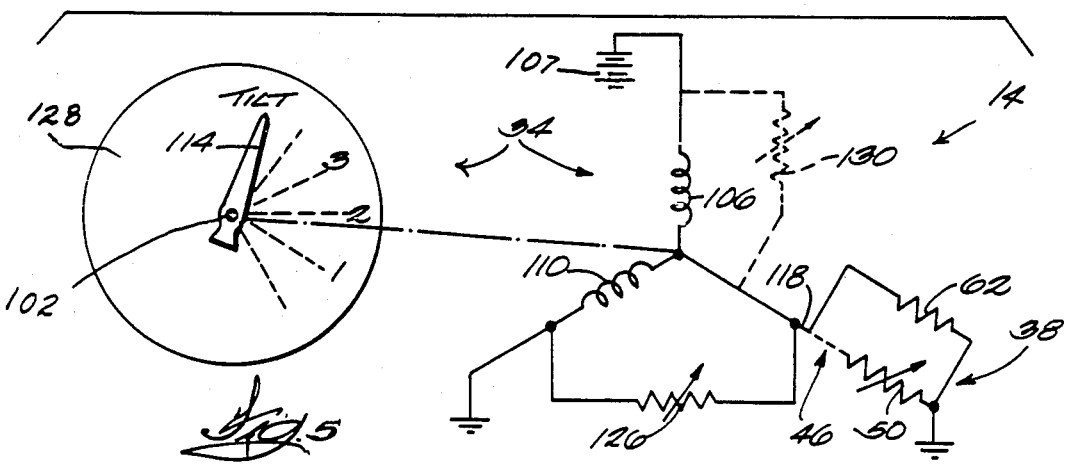
Fig. 5

MARINE PROPULSION DEVICE WITH SWING ANGLE INDICATION MECHANISM

BACKGROUND OF THE INVENTION

This invention relates to mechanisms provided for indicating the general angular position of a marine propulsion device relative to a boat transom and, more particularly, to trim sending devices and trim gauges.

Attention is directed to the following U.S. Patents:

| Patentee | U.S. Pat. No. | Granted |
|---|---|---|
| W. B. Lurie | 2,681,435 | June 15, 1954 |
| J. R. Baskett | 3,380,011 | April 23, 1968 |
| W. A. Barden | 3,564,476 | February 16, 1971 |
| Kenneth W. Wise | 3,601,082 | August 24,1971 |
| Robert C. Schmiedel | 3,641,965 | February 15, 1972 |
| Lambrecht, et al. | 3,722,456 | March 27, 1973 |
| Lyle C. Pinkerton | 3,750,617 | August 7, 1973 |
| Carpenter, et al. | 3,797,449 | March 19, 1974 |
| Hager, et al. | 3,834,345 | September 10, 1974 |
| Collis, et al. | 3,844,247 | October 29, 1974 |
| Michael Hentschel | 3,848,185 | November 12, 1974 |
| Drabenko, et al. | 3,886,448 | May 27, 1975 |
| Hager, et al. | 3,894,250 | July 8, 1975 |
| Lambrecht, et al. | 3,929,089 | December 30, 1975 |
| Collis, et al. | 3,931,784 | January 13, 1976 |
| J. A. Davis | 4,005,674 | February 1, 1977 |
| Woodfill, et al. | 4,051,801 | October 4, 1977 |
| Wenstadt, et al. | 4,318,699 | March 9, 1982 |
| Ludwig Lohner | 4,364,733 | December 21, 1982 |
| Donald O. West | 4,420,741 | December 13, 1983 |
| Arthur R. Ferguson | 4,449,945 | May 22, 1984 |
| E. I. Ballard | 4,459,115 | July 10, 1984 |
| Lambrecht, et al. | Re. 28,816 | May 18, 1976 |

SUMMARY OF THE INVENTION

This invention provides a device operable for sensing the general angular position of a propulsion unit adapted to be mounted on a boat transom for swinging movement. The device comprises signal sending means for producing a signal operable to control a means for producing a visual indication of the general angular position of the propulsion unit, and means for producing a discontinuous change in the signal when the propulsion unit travels through a predetermined angle.

This invention also provides a device operable for sensing the general angular position of a propulsion unit adapted to be mounted on a boat transom for swinging movement through a predetermined angle, the device comprising a resistance element, a fixed resistor in parallel electrical connection with the resistance element, a wiper supported for pivotal movement along the resistance element, and means adapted to be responsive to the swinging movement of the propulsion unit for moving the wiper along the resistance element as the propulsion unit moves through the predetermined angle, and for removing the resistance element from parallel electrical connection with the fixed resistor as the propulsion unit moves beyond the predetermined angle.

This invention also provides a marine propulsion device including a propulsion unit, means for mounting the propulsion unit on a boat transom for swinging movement, and a sending device for sensing the general angular position of the propulsion unit. The sending device comprises a resistance element, and a wiper supported on one of the propulsion unit and the mounting means for pivotal movement along the resistance element. The marine propulsion device also includes means operable between the wiper and the other of the propulsion unit and the mounting means for moving the wiper along the resistance element in an amount which is variably proportional to the amount of swinging movement of the propulsion unit.

This invention also provides a marine propulsion device including a propulsion unit, means for mounting the propulsion unit on a boat transom for swinging movement, a curved camming surface on one of the propulsion unit and the mounting means, and a sending device for sensing the general angular position of the propulsion unit. The sending device comprises a lever pivotally mounted on the other of the propulsion unit and the mounting means and having an end adjacent the curved camming surface, means for biasing the lever end into contact with the curved camming surface so that the lever pivots in a manner determined by the curved camming surface as the propulsion unit swings, a resistance element, and a wiper supported by the other of the propulsion unit and the mounting means for pivotal movement along the resistance element, and connected to the lever for common pivotal movement so that the wiper moves along the resistance element as the lever and the propulsion unit swing.

In one embodiment, the propulsion unit swings about a pivot axis, the mounting means includes a gimbal ring, and the sending device is mounted on the gimbal ring and spaced from the pivot axis.

One of the principal features of the invention is the provision of a device operable for sensing the amount of swinging movement of a propulsion unit adapted to be mounted on a boat transom for swinging movement, the device including means for visually indicating the general angular position of the propulsion unit, and means for producing a discontinuous change in the visual indication when the propulsion unit swings through a predetermined angle. When the predetermined angle is near the point where the propulsion unit leaves a trim range and enters a tilt range, the discontinuous change in the visual indicator provides an easily perceived and understood indication of this occurrence.

Another of the principal features of the invention is the provision of a marine propulsion device including a propulsion unit, means for mounting the propulsion unit on a boat transom for swinging movement, and a movement sensing or sending device. The sending device includes a resistance element and a wiper supported for pivotal movement along the resistance element, and the marine propulsion device further includes means for moving the wiper along the resistance element in an amount which is variably proportional to the amount of swinging movement of the propulsion unit. This feature permits the sending device, when connected to an indicator for visually indicating the amount of swinging movement, to provide any desired change in the visual indicator different from the change in resistance of the sending device as the wiper moves along the resistance element.

Another of the principal features of the invention is the provision of such a sending device which provides a change in a visual indication of the general angular position of a propulsion unit which is directly proportional to the actual change in the angular position of the propulsion unit.

Other features and advantages of the invention will become apparent upon reviewing the following description, the drawing, and the appended claims.

BRIEF DESCRIPTION OF THE DRAWINGS

FIG. 1 is a schematic side view representation of a marine propulsion device which embodies various of the features of the invention.

FIG. 2 is an enlarged view of a portion of the marine propulsion device including a trim sending device which embodies various of the features of the invention.

FIG. 3 is a cross-sectional view of the trim sending device taken along the line 3—3 in FIG. 2.

FIG. 4 is a cross-sectional view of the trim sending device taken along the line 4—4 in FIG. 3.

FIG. 5 is a schematic representation of a mechanism which is for measuring and visually indicating generally the angular position of the marine propulsion device shown in FIG. 1 and which embodies various of the features of the invention.

FIG. 6 is a perspective view of a trim gauge which embodies various of the features of the invention.

Before an explanation of the invention in detail, it is to be understood that the invention is not limited in its application to the details of the construction and the arrangement of components set forth in the following description or illustrated in the drawings. The invention is capable of other embodiments and of being practiced and carried out in various ways. It is also to be understood that the phraseology and terminology employed herein is for the purpose of description and not of limitation.

DESCRIPTION OF THE PREFERRED EMBODIMENT

Illustrated in the drawings is a marine propulsion device 10 which includes a mechanism 14 for indicating the amount of swinging movement or angular position of a propulsion unit 18 mounted on a boat transom 22. In the illustrated construction, the marine propulsion unit 18 is in the form of a stern drive and the propulsion unit 18 is mounted on the boat transom 22 by mounting means in the form of a gimbal housing arrangement 24. The gimbal housing arrangement 24 comprises a transom or gimbal housing 26 connected to the boat transom 22, and a gimbal ring 27 mounted on or within the gimbal housing 26 for horizontal swinging movement. The propulsion unit 18 is pivotally connected to the gimbal ring 27 for vertical swinging movement. Accordingly, the gimbal housing arrangement 24 permits swinging of the propulsion unit 18 horizontally about a generally vertical axis for steering, and swinging of the propulsion unit 18 vertically about a generally horizontal pivot axis 23 for trimming and tilting.

Means is also provided in the form of a tilt and trim cylinder assembly 28 connected between the gimbal ring 27 and the propulsion unit 18 for swinging the propulsion unit 18 vertically relative to the boat transom 22.

The propulsion unit 18 also includes a lower unit 29 rotatably supporting a propeller 30, and means (not shown) for rotating the propeller 30.

Although other constructions can be employed in other embodiments, the indicating mechanism 14 (see FIG. 5) provides a visual indication of the general angular position of the propulsion unit 18 relative to the boat transom 22. More particularly, the indicating mechanism 14 shows the general angular position of the propulsion unit 18 as the propulsion unit 18 swings vertically relative to the boat transom 22 through a first angle. The mechanism 14 then indicates the propulsion unit 18 is located at some angular position beyond the first angle. In this particular embodiment, the first angle is a trim angle or range, and movement of the propulsion unit 18 beyond the trim angle is referred to as the tilt angle or range of the propulsion unit 18. Movement of the propulsion unit 18 through the trim range generally provides for raising and lowering of the bow of the boat to change the attitude of the boat while under power, and movement of the propulsion unit 18 through the tilt angle raises the propulsion unit 18 out of the water for service or storage. The propulsion unit may be operated in the lower portion of the tilt range for low power operation in shallow water.

The indicating mechanism 14 includes means in the form of a trim gauge 34 (see FIGS. 5 and 6) for producing a general visual indication of the angular position of the propulsion unit 18, and signal sending means in the form of a trim sending device 38 for producing a signal operable to control the trim gauge 34.

More particularly, as illustrated in FIGS. 2 through 5, the trim sending device 38 comprises a housing 42, and a variable resistor 46 (see FIG. 4) including a resistance element 50 supported within the housing 42 and having an end 54, a fixed resistor 62 in parallel electrical connection with the variable resistor 46, and a wiper 58 supported within the housing 42 for pivotal movement along the resistance element 50. Although other constructions can be used in other embodiments. the housing 42 is mounted on the gimbal ring 27 in spaced relation from the generally horizontal pivot axis 23, The trim sending device 38 also includes moving means adapted to be responsive to the swinging movement of the propulsion unit 18 for moving the wiper 58 along the resistance element 50 as the propulsion unit 18 moves through the trim angle, and for moving the wiper 58 beyond the resistance element end 54 as the propulsion unit 18 moves beyond the predetermined angle. Although other constructions can be used in other embodiments, such moving means comprises a lever 66 (see FIGS. 2 and 3) pivotally mounted on the housing 42. The wiper 58 is connected to the lever 66 for common pivotal movement so that the wiper 58 moves along the resistance element 50 as the lever 66 pivots relative to the trim sending device housing 42. More particularly, as illustrated in FIGS. 3 and 4, a pin 70 pivotally mounts one end of the lever 66 on the housing 42 and connects the lever 66 to the wiper 58.

In other embodiments (not shown), the wiper 58 can be connected at the pivot axis 23 to one of the propulsion unit 18 and the gimbal ring 27, and the resistance element 50 can be mounted on the other of the propulsion unit 18 and the gimbal ring 27. An advantage of having the housing 42 spaced from the pivot axis 23 and of using the lever 66, however, is that a small amount of propulsion unit swing results in a greater amount of swing of the lever 66 and wiper 58, thereby increasing the amount of change in resistance produced by a change in the angle of the propulsion unit 18. As a result, the sending device 38 is more sensitive to propulsion unit movement.

As illustrated in FIG. 2, the moving means also includes means operable between the wiper 58 and the propulsion unit 18 for moving the wiper 58 along the resistance element 50 in an amount which is variably proportional to the amount of swinging movement of the propulsion unit 18. More particularly, the variable proportional moving means comprises a curved camming surface 78 on the propulsion unit 18 adjacent the free end 74 of the lever 66, and means for biasing the free end 74 of the lever 66 into contact with the curved camming surface 78 so that the lever 66 pivots in a manner determined by the curved camming surface 78 as the propulsion unit 18 swings. More particularly, as illustrated in FIGS. 2 and 3, the biasing means is in the form of a torsion spring 82 concentric with the pin 70 and having a first end 86 fixed on the trim sending device housing 42, and a second end 90 which engages the lever 66 to rotate the lever 66 clockwise when viewed as in FIGS. 1 and 2.

The profile of the curved camming surface 78 can be shaped to provide a linear or nonlinear relationship between the amount of wiper movement and vertical movement of the propulsion unit 18, or to alter the multiplication effect on the amount of wiper movement, or to specifically correct for nonlinearites in the indicating mechanism 14 so that the trim gauge indications are directly proportional to the angle of the propulsion unit 18.

Means is also provided for engaging the lever 66 after the lever 66 and wiper 58 swing through the first angle so that the free end 74 of the lever 66 is positioned to be engaged by the curved camming surface 78 when the propulsion unit 18 swings back into the trim range. In the illustrated embodiment, this means is in the form of a stop 94 which is located on the housing 42 and which engages a tab (not shown) on the lever 66 after the lever 66 swings through the trim range.

The operation of the trim sending device 38 is therefore as follows:

As the lever 66 and wiper 58 pivot with the propulsion unit 18 through the trim range, the wiper 58 moves along the length of the resistance element 50. As the wiper 58 moves along the resistance element 50, the resistance of the variable resistor 46 changes in a manner determined by the type of resistance element used. In some constructions, the change in resistance will be a linear function of the amount of wiper movement, and, in other constructions, the change in resistance will be a nonlinear function of the amount of wiper movement.

The amount of movement of the wiper 58 at a particular time is dependent upon the shape of the curved camming surface 78. In other words, the curved camming surface 78 allows for great or small amounts of wiper movement with each amount of propulsion unit swing. The provision of the camming surface 78 therefore permits one to choose a desired relationship between the amount of propulsion unit swing and the resulting change in the resistance of the variable resistor 46. One such desired relationship is to have the change in resistance, when the sending device 38 is connected to the trim gauge 34, produce a change in the visual indication of trim angle which is directly proportional to the actual change in the trim angle of the propulsion unit 18.

By having the variable resistor 46 and the fixed resistor 62 in parallel electrical connection, the following result is achieved. The resistance of the parallel circuit is equal to the inverse of one over the resistance of the variable resistor 46 plus one over the resistance of the fixed resistor 62. The variable resistor 46, when at its lower resistance, has some small value. As the variable resistor's resistance increases, the total resistance of the parallel circuit increases. At the point where the variable resistor's wiper 58 leaves the end 54 of the resistance element 50, the total resistance provided by the parallel circuit changes in a discontinuous manner and increases significantly. As a result, when the parallel circuit is connected across a voltage source, the discontinuous change in the resistance causes a discontinuous change in current passing through the parallel circuit. This change in resistance, when the trim sending device 38 is connected to the trim gauge 34, produces a discontinuous visual indication of the propulsion unit 18 leaving the trim range and entering the tilt range. This visual indication serves to alert an operator of means for swinging the propulsion unit 18 to discontinue swinging the unit 18 unless tilting of the unit 18 is desired.

When the propulsion unit 58 is in the tilt range, the resulting resistance of the parallel circuit is equal to the value of the fixed resistor 62. Since the manufacturing tolerance of a fixed resistor is better than that of a variable resistor, the resistance of the sending device 38 when the propulsion unit 18 is in the tilt range is more predictable. Accordingly, when the propulsion unit 18 is in the tilt range, a more predictable visual indication is obtained.

In other embodiments, the lever 66 can engage a switch (not shown) which is on the housing 42 and which is electrically connected between the fixed resistor 62 and the variable resistor 46 to open the connection therebetween as the propulsion unit 18 travels beyond the predetermined angle. The switch would thus serve to remove the variable resistor 46 from the parallel circuit in a manner similar to the wiper 58 leaving the resistance element 50.

As illustrated in FIGS. 5 and 6, the trim gauge 34 is of the air-core type and comprises a support in the form of a housing 98, and a magnet 102 supported within the housing 98 for pivotal movement about its longitudinal axis, and a first wire coil 106 adjacent the magnet 102 (as shown schematically in FIG. 5) and adapted to be connected to a power source, such as the illustrated battery 107. The trim gauge 34 also includes a second wire coil 110 magnetically adjacent and in electrical connection with the first coil 106 and connected to ground.

The gauge 34 also includes indicator means in the form of a pointer 114 connected at a right angle at one end to the magnet 102 to indicate the amount of pivotal movement of the magnet 102. The trim gauge 34 also includes a lead 118 electrically connected between the first coil 106 and the second coil 110 and adapted to be connected to the variable resistor 46 in the trim sending device 38. More particularly, the lead 118 is connected to the terminal 122 of the trim sending device 38. The variable resistor 46 and fixed resistor 62 in the trim sending device 38 are connected to ground.

The face 128 of the trim gauge 34 is also illustrated in FIG. 5. The face 128 includes four triming segments separated by lines numbered one through three, and a tilt segment separated by a fourth line. After the pointer 114 sweeps through the triming segments, thereby indicating the general or approximate angular position of the propulsion unit 18, the pointer 114 jumps across the tilt segment, thereby indicating the propulsion unit 18 is now in the tilt range.

In operation, current passing through the first coil 106 and second coil 110 produces a magnetic field. Because the first coil 106 and second coil 110 are magnetically adjacent and extend in opposite directions relative to one another, the amount of current passing through one coil as opposed to the other will determine the magnitude of the magnetic field. The magnitude of the magnetic field determines the amount of torque applied to the permanent magnet 102 and determines the amount of pivotal movement of the magnet 102. Means (not shown) for normally biasing the magnet 102 in one direction is provided for keeping the pointer 114 in a fully deflected position showing no trim angle when the propulsion unit 18 is in its lowermost position. As the propulsion unit 18 swings through the trim range, the resistance of the trim sending device 38 changes, thereby changing the amount of current that passes through the second coil 110. This results in a change in the magnetic field around the magnet 102 and produces a change in the torque applied to the magnet 102. The change in torque applied to the magnet 102 results in rotation of the magnet 102 and movement of the pointer 114.

The trim gauge 34 also includes means for varying the current sensitivity of the gauge. i.e., the sensitivity of the gauge 34 to trim sending device 38 resistance, in the form of a variable resistor 126 in parallel electrical connection with one of the first coil 106 and the second coil 110. More particularly, the variable resistor 126 is in parallel electrical connection with the second coil 110. Adjustment of the variable resistor 126 results in a change in the amount of current that passes through the second coil 110, thereby affecting the resulting position of the pointer 114 produced by the resistance of the trim sending device 38. The effect of the variable resistor 126 on the position of the pointer 114 is greater at greater trim sending device resistances.

In an alternate embodiment, as illustrated by dotted line in FIG. 5, a variable resistor 130 could alternatively be connected in parallel electrical connection with the first coil 106. The variable resistor 130 in this case, however, increases the amount of current that is sent to the trim sending device 38 and risks overloading the device's power rating. Connection of the variable resistor 126 in parallel with the second coil 110 is, therefore, the preferred embodiment for it sends the current to ground.

As illustrated in FIG. 6, the trim gauge 34 also includes means in the form of a knob 134 for adjusting the resistance of the variable resistor 126. The knob 134 is accessible from outside of the housing 98 so that an operator can easily change the resistance to calibrate the trim gauge 34.

Various of the features of the invention are set forth in the following claims.

I claim:

1. A device operable for sensing the general angular position of a propulsion unit adapted to be mounted on a boat transom, said device comprising signal sending means for producing a signal operable to control a means for producing a visual indication of the general angular position of the propulsion unit, and means for producing a discontinuous change in the signal when the propulsion unit travels through a predetermined angle.

2. A device operable for sensing the general angular position of a propulsion unit adapted to be mounted on a boat transom for swinging movement through a predetermined angle, said device comprising a resistance element, a fixed resistor in parallel electrical connection with said resistance element, a wiper supported for pivotal movement along said resistance element, and means adapted to be responsive to the swinging movement of the propulsion unit for moving said wiper along said resistance element as the propulsion unit moves through the predetermined angle, and for removing the resistance element from parallel electrical connection with the fixed resistor as the propulsion unit moves beyond the predetermined angle.

3. A device in accordance with claim 2 wherein said resistance element has an end, and wherein said wiper moves beyond said resistance element end as the propulsion unit moves beyond the predetermined angle.

4. A marine propulsion device including a propulsion unit, means for mounting said propulsion unit on a boat transom for swinging movement through a predetermined angle, and a sending device for sensing the general angular position of said propulsion unit, said sending device comprising a resistance element, a fixed resistor in parallel electrical connection with said resistance element, a wiper supported by one of said propulsion unit and said mounting means for pivotal movement along said resistance element, and means operable between said wiper and the other of said propulsion unit and said mounting means for moving said wiper along said resistance element as said propulsion unit moves through the predetermined angle and for removing the resistance element from parallel electrical connection with the fixed resistor as said propulsion unit moves beyond the predetermined angle.

5. A device in accordance with claim 4 wherein said resistance element has an end, and wherein said wiper moves beyond said resistance element end as the propulsion unit moves beyond the predetermined angle.

6. A marine propulsion device including a propulsion unit, means for mounting said propulsion unit on a boat transom for vertical swinging movement through a predetermined angle about a generally horizontal axis, and a trim sending device for sensing the general angular position of said propulsion unit, said device comprising a housing mounted on one of said propulsion unit and said mounting means, a variable resistor including a resistance element supported by said housing, and a wiper supported by said housing for pivotal movement along said resistance element, a fixed resistor in parallel electrical connection with said variable resistor, and means operable between said wiper and the other of said propulsion unit and said mounting means for moving said wiper along said resistance element as said propulsion unit moves through the predetermined angle, and for removing the variable resistor from parallel electrical connection with the fixed resistor as said propulsion unit moves beyond the predetermined angle.

7. A marine propulsion device in accordance with claim 6 wherein said resistance element has an end, and wherein said wiper moves beyond said resistance element end as the propulsion unit moves beyond the predetermined angle.

8. A marine propulsion device including a propulsion unit, means for mounting said propulsion unit on a boat transom for swinging movement, and a sending device for sensing the general angular position of said propulsion unit, said sending device comprising a resistance element, a wiper supported on one of said propulsion unit and said mounting means for movement along said resistance element, and means operable between said wiper and the other of said propulsion unit and said mounting means for moving said wiper along said resistance element in an amount which varies non-linearly in relation to the amount of swinging movement of said propulsion unit.

9. A marine propulsion device including a propulsion unit, means for mounting said propulsion unit on a boat transom for swinging movement, a curved camming surface on one of said propulsion unit and said mounting means, and a sending device for sensing the general angular position of said propulsion unit, said sending device comprising a lever pivotally mounted on the other of said propulsion unit and said mounting means and having an end adjacent said curved camming surface, means for biasing said lever end into contact with said curved camming surface so that said lever pivots in a manner determined by said curved camming surface as said propulsion unit swings, a resistance element, and a wiper supported by the other of said propulsion unit and said mounting means for pivotal movement along said resistance element, and connected to said lever for common pivotal movement so that said wiper moves along said resistance element as said lever and said propulsion unit swing.

10. A marine propulsion device in accordance with claim 9 wherein said propulsion unit swings about a pivot axis, and wherein said mounting means includes a gimbal ring, and wherein said sending device is mounted on said gimbal ring and spaced from said pivot axis.

11. A marine propulsion device in accordance with claim 9 wherein said propulsion unit swings through a predetermined angle and about a pivot axis, and wherein said sending device further comprises a housing mounted on the other of said propulsion unit and said mounting means, and said lever is pivotally mounted on said housing, and a stop on said housing which engages said lever when said propulsion unit is beyond the predetermined angle.

12. A marine propulsion device in accordance with claim 11 wherein said resistance element is supported by said housing, and said wiper is supported by said housing for pivotal movement along said resistance element, and wherein said sending device further includes a fixed resistor, and means for removing said resistance element from electrical connection with said fixed resistor when said lever and said propulsion unit move beyond the predetermined angle.

13. A marine propulsion device including a propulsion unit, means for mounting said propulsion unit on a boat transom for swinging movement through a predetermined angle, and a sending device for sensing the general angular position of said propulsion unit, said sending device comprising signal sending means for producing a signal operable to control a means for producing a visual indication of the general angular position of said propulsion unit, and means for producing a discontinuous change in the signal as said propulsion unit travels through the predetermined angle.

* * * * *